United States Patent [19]

Pucci

[11] 3,935,423

[45] Jan. 27, 1976

[54] HAIRDRESSING DEVICE

[76] Inventor: Massimo Pucci, Via Borsi 41, Livorno, Italy, I-57100

[22] Filed: July 1, 1974

[21] Appl. No.: 484,878

[30] Foreign Application Priority Data

July 3, 1973 Italy ..... 17405/73

[52] U.S. Cl. ..... 219/225; 132/37; 132/118; 132/122; 132/142; 219/230

[51] Int. Cl.[2] ..... H05B 1/00; A45D 1/04

[58] Field of Search ..... 132/112, 117, 118, 122, 132/141, 142, 144, 145, 31, 32 R, 32 A, 32 B, 32 C, 37; 219/222–225, 230, 112, 117, 118, 141, 142, 122, 144, 145, 31, 32, 37

[56] References Cited

UNITED STATES PATENTS

| | | | |
|---|---|---|---|
| 1,588,241 | 6/1926 | Leland | 132/32 R |
| 1,591,065 | 7/1926 | Wertheim et al. | 132/32 B |
| 1,605,540 | 11/1926 | Gibney | 132/32 R X |
| 1,622,821 | 3/1927 | Beesley | 132/118 |
| 1,861,040 | 5/1932 | Williams | 132/142 X |
| 3,224,454 | 12/1965 | Quinio et al. | 219/225 UX R |
| 3,698,402 | 10/1972 | Arnesen | 219/225 UX R |

FOREIGN PATENTS OR APPLICATIONS

| | | | |
|---|---|---|---|
| 37,551 | 5/1927 | Denmark | 132/32 R |

*Primary Examiner*—A. Bartis
*Attorney, Agent, or Firm*—McGlew and Tuttle

[57] ABSTRACT

A hairdressing device comprises an elongate circular cross-section cylindrical body having a relatively small diameter adapted to the size of a hair curl, and a gripping handle extending from one end of the body. A first rectilinear row of comb teeth extends radially from the body, and second and third rectilinear rows of comb teeth extend from the body in opposite sides of the first row and spaced symmetrically relative to the first row. A relatively thin pliers or pressure member is articulated to the body adjacent the handle, and has an operating portion adjacent the handle and an active portion extending in alignment with the first row of comb teeth and movable toward the body to press the hair against the body. The active portion of the pliers or pressure member has an elongated slot therein through which the comb teeth of the first row extend when the active portion is substantially engaged with the body. The body is heated uniformly throughout its length, for example by electrical heating elements or by a stream of hot air and the comb teeth are also heatable. By virtue of the provision of the three rows of teeth, with the first row extending through the slot in the active portion of the pliers or pessure member, the device may be used equally as a heated hair curler or as a heated comb.

3 Claims, 3 Drawing Figures

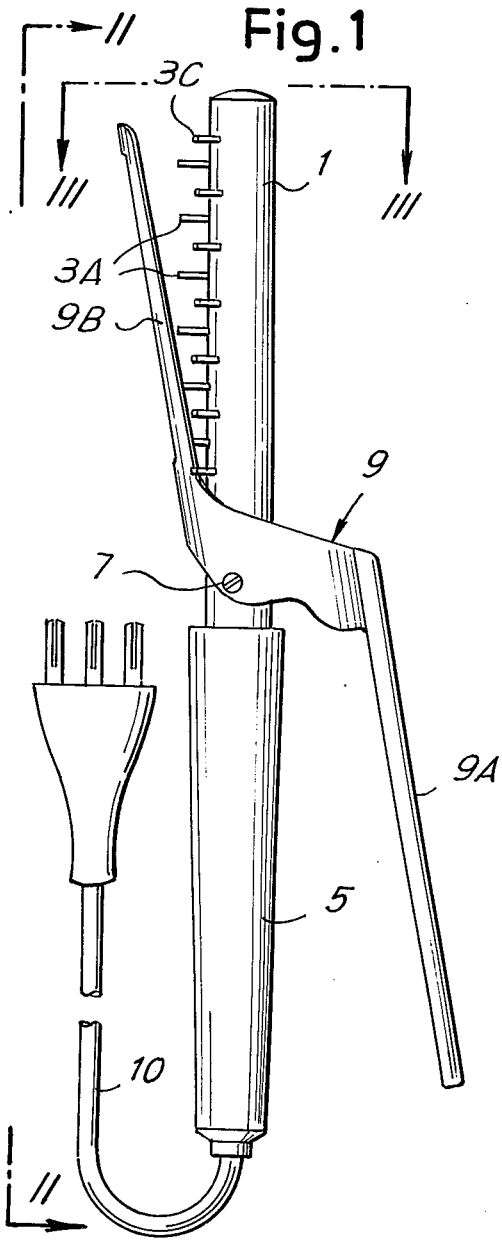
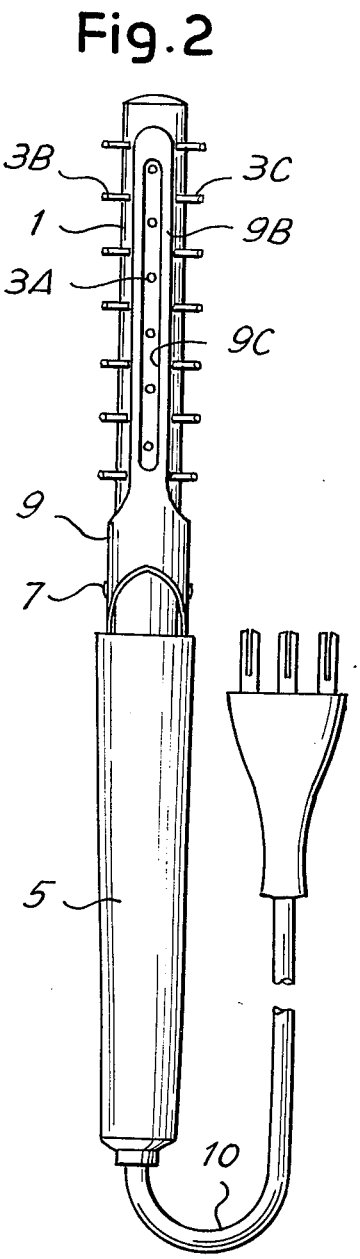
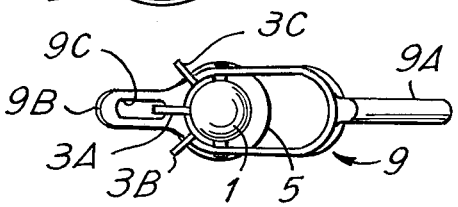
Fig.3

HAIRDRESSING DEVICE

BACKGROUND OF THE INVENTION

1. Field of the Invention

The present invention relates to hairdressing devices, and more particularly to hairdressing devices for brushing, combing, and heating hair or wigs.

2. Description of the Prior Art

Conventional methods of hairdressing are long and laborious. The first stage in the operation is to wash the hair. According to the method employed, to the type of hair, or to the result desired, the second stage can involve setting the hair before drying by appropriate devices. Alternatively, the second stage can involve drying the hair by means of a "hair-drier" while the desired style is formed using a comb or brush. In the third and final stage, when the hair has dried and the various tools which were used to give the style its preliminary shape have been removed, the operation is completed by means of a comb or bursh.

The present invention aims to eliminate some stages of the method, to reduce the times of the remaining stages, and to facilitate the obtaining of results that cannot be obtained by the conventional methods hitherto described.

SUMMARY OF THE INVENTION

According to the invention, there is provided a hairdressing device comprising an elongate heated body, having a gripping handle, a row of comb teeth extending from the body, and a pliers member articulated to the body, the pliers member having an operational portion in correspondence with the handle, and an active portion, portion lying in front of the row of teeth, and being arranged to move towards the body whereby to press the hair against the body.

BRIEF DESCRIPTION OF THE DRAWINGS

An embodiment of the invention will now be described, by way of example only, with reference to the accompanying drawings, in which:

FIG. 1 is a side elevation of a hairdressing device in accordance with the invention; and FIGS. 2 and 3 are veiws taken on lines II—II and III—III, respectively of FIG. 1.

DESCRIPTION OF THE PREFERRRED EMBODIMENT

The hairdressing device shown in the drawings is in the form of a brush comprising a body 1 of metal or other suitable material, the body 1 being of cylindrical or other suitable shape. The body 1 is provided with a longitudinal row of radial teeth 3A of variable length and shape, the teeth 3A being slightly tapered for structural requirements. Additional rows of radial teeth 3B and 3C can be provided at each side of the row of teeth 3A. A grip or handle 5 is integral with the body 1.

A pliers or pressure member 9 is articulated on the body 1 at 7, and has an operational or handle portion 9A lying at the side of the handle 5, and an active or jaw portion 9B lying in front of the row of teeth 3A. The active portion 9B is provided with a longitudinal slot 9C, which is aligned with the teeth 3A such that the teeth extend through the slot 9C when the active portion 9B is moved towards the body 1.

With the device described, one may engage the hair between the body 1 and the section 9B, in such a manner that the hair is pressed against the surface of the body 1 and is combed by means of the teeth. For advantageous results, it is preferred that the teeth are arranged in three rows, as indicated by 3A, 3B and 3C, but satisfactory results can also be obtained using the single row of teeth 3A, which vary in number and distance. The pliers member 9 is movable in such a manner that it enables ease of insertion into the hair, and permits a large or small frictional pressure to be exerted between the body 1 and the hair.

The interior of the body 1 contains means — for example electrical resistance heating elements fed by a cable 10 — which effect heating of the surface of the body, and thus of the hair. Heating may also be obtained by means of air-stream discharged through perforations or other holes in the surface of the body. Means can be provided to obtain different temperatures, although it is possible for the device to operate at a single temperature, according to the results desired.

The combined effects of the heat, the pressure exerted by the pliers member and the combing action provided by the teeth 3A (and the teeth 3B and 3C if present) lead to efficient action of the device.

More particularly, the hair, clamped with a variable pressure between the body 1 and the active portion 9B of the pliers member and retained by the brush teeth, is shaped as desired by the hairdresser, without the need for an additional tool. This is permitted by the teeth with which the device is provided, since in this manner the hair cannot escape from the device and is combed during the treatment. This "trapping" effect of the hair is important because it allows a large number of different hair-styles to be created. Without the action of the pliers member on the toothed support, this would not be possible.

The device particularly described provides the following advantages:

1. When setting waves in the hair the use of conventional tools such as pincers or rollers is eliminated, thus reducing the time required and the labor involved;
2. The time required to dry the hair is reduced since the device is heated;
3. Whereas using conventional methods, an assistant may be required to hold a hair-drier while the hairdresser combs the hair, the device described enables the hairdresser to work alone;
4. The hair-shaping which imparts the final shape to the hair-style can be effected quicker and with better results than by using conventional brushes or combs;
5. The hair-style obtained will last substantially a longer duration than a style obtained by conventional methods;
6. The hair automatically assumes an accentuated brightness, due to the heating action.

What is claimed is:

1. A hairdressing device comprising, in combination, an elongated circular cross-section cylindrical body having a relatively small diameter adapted to the size of a hair curl; heating means in said body operable to heat said body uniformly throughout its length; a gripping handle secured to one end of said body; a first longitudinally extending rectilinear row of comb teeth projecting radially from said body; second and third longitudinally extending rectilinear rows of comb teeth projecting radially from said body on opposite sides of said first row and spaced symmetrically relative to said first row to define therewith a hair brush; said comb teeth being in heat exchange relationship with said body so as to be heatable by said heating means; and a relatively thin pliers member articulated to said body, and having an operating portion adjacent said handle and an elongated active portion extending in alignment with said first row of comb teeth and movable toward engagement with said body to press the hair against said body for curling of the hair between said active portion and said body; said active portion having a width less than the spacing of the second and third teeth rows from each other so as to be movable into the space between said second and third teeth rows and having an elongated slot therein through which the comb teeth of said first row extend when said active portion is substantially engaged with said body, said three rectlinear rows of comb teeth providing for said device to be used to brush the hair with heated comb teeth.

2. A hairdressing device, as claimed in claim 1, in which said relatively thin pliers member is pivoted, intermediate its operating and active portions, on a pivot pin extending diametrically of said body adjacent said handle; said operating and active portions being located, relative to said pivot pin, on respective opposite sides of said handle and said body.

3. A hairdressing device, as claimed in claim 1, in which the comb teeth of said second and third rows are staggered longitudinally relative to the comb teeth of said first row.

* * * * *